US011532442B2

(12) United States Patent
Takeda

(10) Patent No.: US 11,532,442 B2
(45) Date of Patent: Dec. 20, 2022

(54) ELECTRONIC DEVICE WITH CASE HAVING SHEATH-PIERCING TAPERED SECTIONS

(71) Applicant: Uchiya Thermostat Co., Ltd., Saitama (JP)

(72) Inventor: Hideaki Takeda, Misato (JP)

(73) Assignee: Uchiya Thermostat Co., Ltd., Saitama (JP)

( * ) Notice: Subject to any disclaimer, the term of this patent is extended or adjusted under 35 U.S.C. 154(b) by 78 days.

(21) Appl. No.: 17/250,176

(22) PCT Filed: Feb. 21, 2019

(86) PCT No.: PCT/JP2019/006460
§ 371 (c)(1),
(2) Date: Dec. 8, 2020

(87) PCT Pub. No.: WO2020/003596
PCT Pub. Date: Jan. 2, 2020

(65) Prior Publication Data

US 2021/0159026 A1 May 27, 2021

(30) Foreign Application Priority Data

Jun. 27, 2018 (JP) ..... JP2018-122227

(51) Int. Cl.
*H01H 9/30* (2006.01)
*H01H 9/50* (2006.01)
(Continued)

(52) U.S. Cl.
CPC ..... *H01H 9/30* (2013.01); *G05F 1/569* (2013.01); *G05F 1/571* (2013.01); *H01C 1/16* (2013.01);
(Continued)

(58) Field of Classification Search
CPC ..... H01H 9/30; H01H 9/54; H01H 9/50
See application file for complete search history.

(56) References Cited

U.S. PATENT DOCUMENTS 6,346,796 B1 * 2/2002 Takeda ..... H01H 61/02 337/79
7,079,363 B2 * 7/2006 Chung ..... H01H 9/542 361/13
(Continued)

FOREIGN PATENT DOCUMENTS

CN 109950866 A * 6/2019
DE 102015212802 A1 * 1/2017 ..... H01H 1/20
(Continued)

OTHER PUBLICATIONS

"International Application Serial No. PCT/JP2019/006460, International Search Report dated May 21, 2019", (May 21, 2019), 1 pg.
(Continued)

*Primary Examiner* — Sisay G Tiku
(74) *Attorney, Agent, or Firm* — Schwegman Lundberg & Woessner, P.A.

(57) ABSTRACT

An electronic device (10) includes: a power supply (11); a first switch (12) that is connected at least to one pole of the power supply (11) and interrupts power supplied from the power supply (11) to a load (13); a second switch (14) that is positioned on a load (13) side with reference to the first switch (12) and interrupts power supplied from the power supply (11) to the load (13); a first power line (L11) that is connected to one end portion of an electric contact of the second switch (14), the one end portion being located on a first-switch (12) side; a second power line (L12) that is connected to another end portion of the electric contact of the second switch (14); a third power line (L13) that is connected to another pole of the power supply (11); and an electric element (resistor 15) that is connected between the
(Continued)

first and second power lines (L11, L12) in parallel to the electric contact or connected between the first and third power lines (L11, L13), such that the electric contact of the second switch (14) is not charged when the first and second switches (12, 14) interrupt power.

5 Claims, 17 Drawing Sheets

(51) Int. Cl.

| | |
|---|---|
| ***H01H 9/54*** | (2006.01) |
| ***H01H 1/60*** | (2006.01) |
| ***H01H 9/02*** | (2006.01) |
| ***G05F 1/569*** | (2006.01) |
| ***G05F 1/571*** | (2006.01) |
| ***H01C 1/16*** | (2006.01) |
| ***H01H 9/42*** | (2006.01) |
| ***H01H 33/16*** | (2006.01) |

(52) U.S. Cl.
CPC ..... *H01H 1/60* (2013.01); *H01H 9/02* (2013.01); *H01H 9/42* (2013.01); *H01H 33/167* (2013.01); *H01H 9/50* (2013.01)

(56) References Cited

U.S. PATENT DOCUMENTS

| | | | | |
|---|---|---|---|---|
| 2004/0169969 | A1* | 9/2004 | Takeda | H01H 37/54 361/42 |
| 2005/0174211 | A1* | 8/2005 | Takeda | H01H 9/42 337/377 |
| 2005/0189206 | A1* | 9/2005 | Takeda | H01H 1/2016 200/400 |
| 2012/0001721 | A1* | 1/2012 | Takeda | H01H 37/5427 337/372 |
| 2012/0212210 | A1* | 8/2012 | Takeda | H01H 1/504 323/369 |
| 2014/0111299 | A1* | 4/2014 | Takeda | H01H 37/52 337/85 |
| 2015/0292954 | A1* | 10/2015 | Takeda | G01K 1/08 374/183 |
| 2018/0012717 | A1 | 1/2018 | Kohinata et al. | |
| 2020/0027679 | A1* | 1/2020 | Takeda | H01H 1/504 |
| 2020/0118777 | A1* | 4/2020 | Takeda | H01H 37/52 |
| 2021/0336411 | A1* | 10/2021 | Dejima | H01S 5/0237 |
| 2021/0391131 | A1* | 12/2021 | Takeda | H05B 45/56 |

FOREIGN PATENT DOCUMENTS

| | | | | | |
|---|---|---|---|---|---|
| EP | 2777059 | B1 | * | 2/2022 | H01H 33/596 |
| JP | 05232176 | A | | 9/1993 | |
| JP | 10247433 | A | | 9/1998 | |
| JP | 2004103383 | A | | 4/2004 | |
| JP | 2008071514 | A | | 3/2008 | |
| JP | 2008072839 | A | | 3/2008 | |
| JP | 2009117150 | A | | 5/2009 | |
| JP | 2014216056 | A | | 11/2014 | |
| JP | 2015050080 | A | * | 3/2015 | |
| JP | 2015225812 | A | * | 12/2015 | |
| JP | 2016062790 | A | | 4/2016 | |
| JP | 2017527067 | | * | 9/2017 | |
| JP | 2018006209 | A | | 1/2018 | |
| JP | 6352745 | B2 | * | 7/2018 | |
| JP | 2019115030 | A | * | 7/2019 | |
| WO | WO-2013093066 | A1 | * | 6/2013 | H01H 33/596 |

OTHER PUBLICATIONS

"International Application Serial No. PCT/JP2019/006460, Written Opinion dated May 21, 2019", (May 21, 2019), 7 pgs.

* cited by examiner

ELECTRONIC DEVICE WITH CASE HAVING SHEATH-PIERCING TAPERED SECTIONS

PRIORITY APPLICATIONS

This application is a U.S. National Stage Filing under 35 U.S.C. § 371 from International Application No. PCT/JP2019/006460, filed on Feb. 21, 2019, and published as WO2020/003596 on Jan. 2, 2020, which claims the benefit of priority to Japanese Application No. 2018-122227, filed on Jun. 27, 2018; the benefit of priority of each of which is hereby claimed herein, and which applications and publication are hereby incorporated herein by reference in their entirety.

TECHNICAL FIELD

The present invention relates to an electronic device that includes an electric contact.

BACKGROUND ART

Conventionally, electric contacts have occasionally had a contact failure due to foreign matter, and methods for addressing the occurrence of contact failures have been studied.

Examples of such methods include: a method wherein foreign matter in the vicinity of an electric contact is caused to adhere to, and thus be held on, portions other than the electric contact (see, for example, patent document 1); a method wherein one contact located on one side and forming an electric contact is separated, and if foreign matter adheres to the separated one contact, the other contact attains conductivity, thereby reducing conduction failure (see, for example, patent document 2); a method wherein contacts in contact with each other are shaped like mountains, and mountain-shaped portions are brought into contact with each other in such a manner as to cross each other, thereby reducing conduction failure (see, for example, patent document 3); a method wherein when energization of an electromagnetic relay cannot be confirmed, foreign matter is burned off through repetitive operations (see, for example, patent document 4); and a method wherein a determination is made by means of a resistor connected in parallel to an electric contact in a closed state (see, for example, patent document 5).

PRIOR ART DOCUMENTS

Patent Documents

Patent Document 1: Japanese Laid-open Patent Publication No. 10-247433

Patent Document 2: Japanese Laid-open Patent Publication No. 2018-6209

Patent Document 3: Japanese Laid-open Patent Publication No. 2009-117150

Patent Document 4: Japanese Laid-open Patent Publication No. 2008-72839

Patent Document 5: Japanese Laid-open Patent Publication No. 5-232176

SUMMARY OF THE INVENTION

Problems to be Solved by the Invention

In the meantime, when electric conduction is stopped by disconnecting a circuit section including an electric contact from a main power supply, the electric contact is placed in an open-circuit state and is thus electrically open. Especially when the electric contact is in an open-circuit state for a long time or placed in high-temperature environment, the electric contact is charged due to electrostatic conduction from outside and thus attracts foreign matter.

In the above conventional methods, measures are taken using electric contacts, and the bottom cause of non-conductive foreign matter being stuck between the electric contacts cannot be solved.

An object of the present invention is to provide an electronic device that can reduce the occurrence of contact failures caused by foreign matter on an electric contact.

Means for Solving Problems

In an aspect, an electronic device includes: a power supply; a first switch that is connected at least to one pole of the power supply and interrupts power supplied from the power supply to a load; a second switch that is positioned on a load side with reference to the first switch and interrupts power supplied from the power supply to the load; a first power line that is connected to one end portion of an electric contact of the second switch, the one end portion being located on a first-switch side; a second power line that is connected to another end portion of the electric contact of the second switch; a third power line that is connected to another pole of the power supply; and an electric element that is connected between the first and second power lines in parallel to the electric contact or connected between the first and third power lines, such that the electric contact of the second switch is not charged when the first and second switches interrupt power.

Effect of the Invention

The present invention allows for reducing the occurrence of contact failures caused by foreign matter on an electric contact.

DESCRIPTION OF EMBODIMENTS

Figure 1:
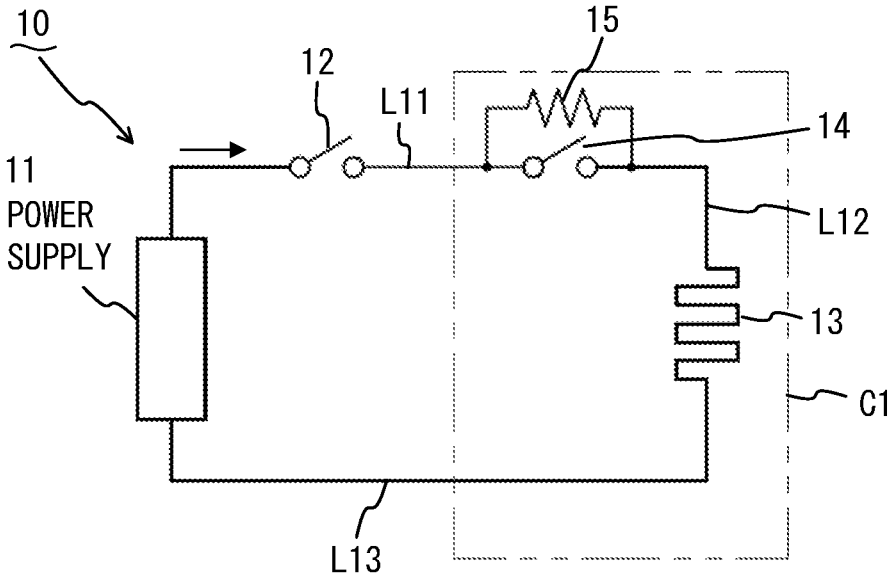
FIG. 1 is a circuit diagram illustrating an electronic device in accordance with a first example.

The following describes an electronic device in accordance with embodiments of the present invention by referring to the drawings.

FIG. 1 is a circuit diagram illustrating an electronic device in accordance with a first example.

As depicted in FIG. 1, an electronic device 10 includes a power supply 11, a first switch 12, a load 13, a second switch 14, and a resistor 15, i.e., an example of an electric element.

The first switch 12, e.g., a power supply switch, is connected at least to the power supply and interrupts power supplied from the power supply 11 to the load 13. In other words, the first switch 12 interrupts power supplied from the power supply 11 to a control electric circuit C1, which includes the load 13, the second switch 14, and the resistor 15.

The load 13 is an electric component, e.g., a heater. The second switch 14 is positioned on the load-13 side with reference to the first switch 12, e.g., between the first switch 12 and the load 13, and interrupts power supplied from the power supply 11 to the load 13. The second switch 14 may be, for example, an electric relay driven by a control voltage from outside, a controller such as a temperature switch operated in accordance with a change in various physical amounts, or a manual operation switch but is not particularly limited as long as the second switch 14 can interrupt power supplied from the power supply 11 to the load 13.

A first power line L11 is connected to one end portion of the electric contact of the second switch 14 that is located on the first-switch-12 side. A second power line L12 is connected to another end portion of the electric contact of the second switch 14. A third power line L13 is connected to the load 13 and an opposite pole of the power supply 11 from the pole to which the first switch 12 is connected. The resistor 15 is connected in parallel to the electric contact of the second switch 14 between the first power line L11 and the second power line L12. The resistor 15 is positioned, for example, outward of the second switch 14 but may be positioned inward of the second switch 14 and connected in parallel to the electric contact of the second switch 14. Power consumption of the resistor 15 is, for example, less than 0.1 W. When the voltage of the power supply 11 is 100 V, the resistance of the resistor 15 may be, for example, 150 kΩ or higher. Alternatively, the resistance of the resistor 15 may be 1 MΩ or higher. Heat generation of the resistor 15 is desirably minimized.

In the meantime, the second switch 14 can be operated most stably when switching control is performed with an appropriate voltage and current. As long as a rated range is not gone beyond, as a general rule, a clean face often emerges on the surface of the electric contact owing to an arc generated when interrupting power, and when the second switch 14 is closed, the contacting is also stabilized by an arc generated by the electric contact bouncing.

When the second switch 14 is placed in a state of interrupting power (i.e., the electric contact of the second switch 14 is in an open-circuit state) after the first switch 12 interrupts power, the arc described above is not generated, and the electric contact cannot be closed in an active state. Thus, even slight foreign matter tends to have some effects. Moreover, depending on the environment outside the electric circuit, ambient static electricity could be retained in a smallest section between separate conductive portions within the electric circuit (electric-contact gap section) because of an electrostatic conduction phenomenon, and thus insulating foreign matter, which is occasionally present in the vicinity of the electric contact, is polarized by an electric field and thus stuck in the gap section in the electric contact due to the influence of a Coulomb force.

In embodiments, accordingly, the resistor 15 is connected in parallel to the electric contact of the second switch 14 such that the electric contact of the second switch 14 is not charged while the first switch 12 and the second switch 14 interrupt power. Thus, foreign matter can be prevented from being attracted to the electric contact of the second switch 14 even when the first switch 12 interrupts power of the power supply 11 and the second switch 14 is in an open-circuit state with the control electric circuit C1, which has been separated from the power supply circuit that includes the power supply 11 and the first switch 12, placed in a non-voltage state.

In this way, the electronic device 10 in accordance with embodiments can reduce the occurrence of contact failures caused by foreign matter on the electric contact of the second switch 14.

Figure 2:
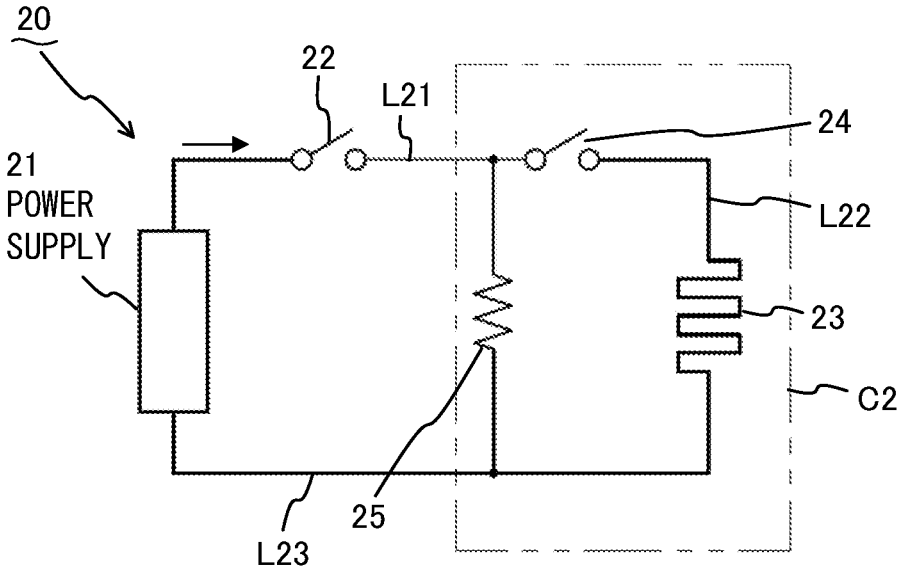
FIG. 2 is a circuit diagram illustrating an electronic device in accordance with a second example.

FIG. 2 is a circuit diagram illustrating an electronic device 30 in accordance with a second example.

As depicted in FIG. 2, the electronic device 20 includes a power supply 21, a first switch 22, a load 23, a second switch 24, and a resistor 25, i.e., an example of an electric element.

The second example is different from the first example only in that the resistor 25 is connected between a first power line L21 and a third power line L23. Accordingly, detailed descriptions are omitted herein.

The resistor 25 is disposed within a control electric circuit C2 and includes one end portion connected to the first power line L21, which is located between the first switch 22 and the second switch 24, and another end portion connected to the third power line L23, which is located between the load 23 and the power supply 21.

Figure 3:
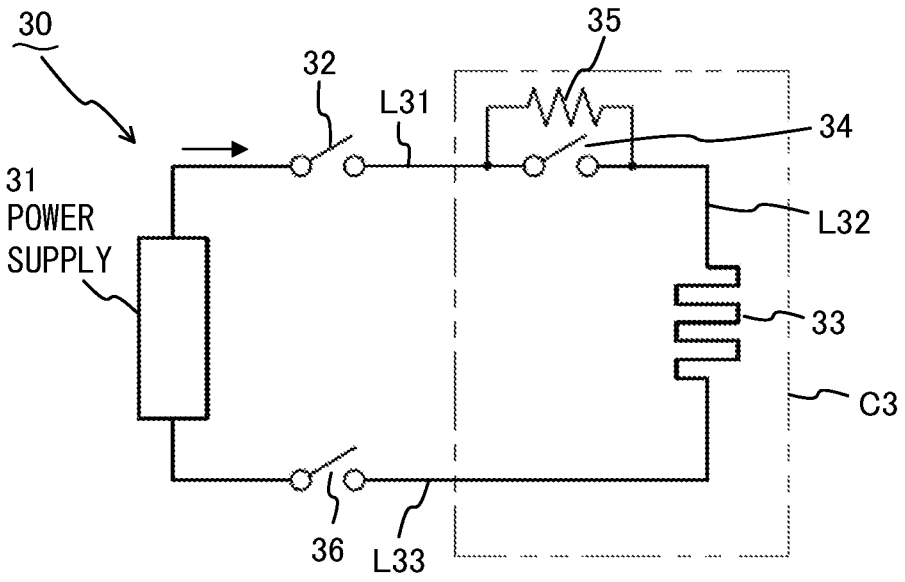
FIG. 3 is a circuit diagram illustrating an electronic device in accordance with a third example.

FIG. 3 is a circuit diagram illustrating an electronic device 30 in accordance with a third example.

As depicted in FIG. 3, the electronic device 30 includes a power supply 31, a first switch 32, a load 33, a second switch 34, a resistor 35, i.e., an example of an electric element, and a third switch 36.

The third example is different from the first example only in that the first switch 32 and the third switch 36 separate two poles of the power supply 31 from each other. Accordingly, detailed descriptions are omitted herein.

Figure 4:
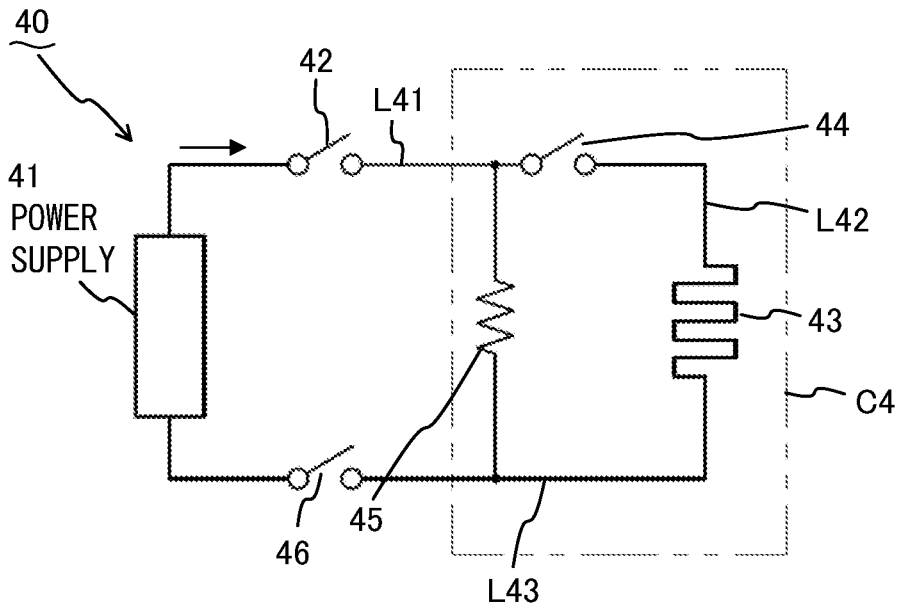
FIG. 4 is a circuit diagram illustrating an electronic device in accordance with a fourth example.

FIG. 4 is a circuit diagram illustrating an electronic device 40 in accordance with a fourth example.

As depicted in FIG. 4, the electronic device 40 includes a power supply 41, a first switch 42, a load 43, a second switch 44, a resistor 45, i.e., an example of an electric element, and a third switch 46.

The fourth example is different from the second example only in that the first switch 42 and the third switch 46 separate two poles of the power supply 41 from each other.

Accordingly, detailed descriptions are omitted herein. In the fourth embodiment, a third power line L43 is connected to the third switch 46 and the load 43. Thus, the third power line L43 is connected to a different pole of the power supply 41 from the pole to which the first switch 42 is connected.

Figure 5:
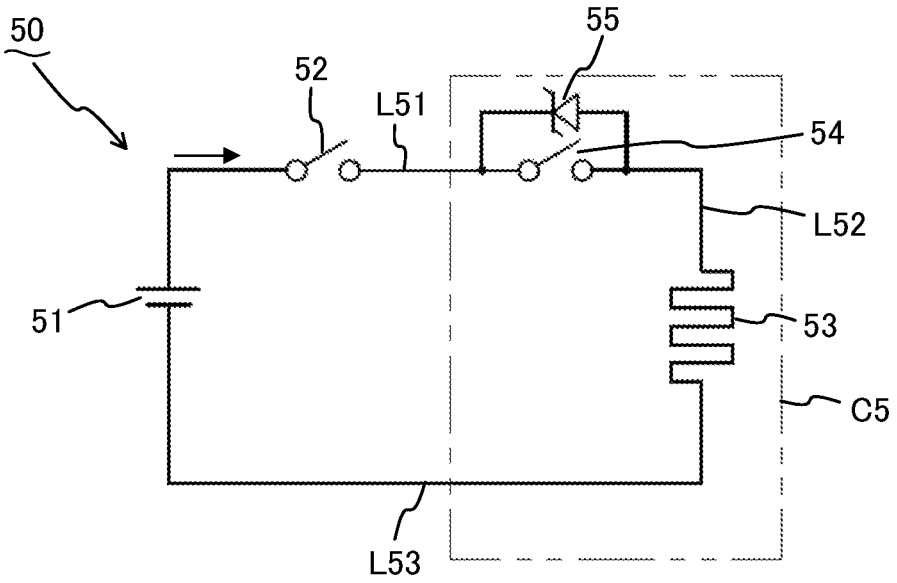
FIG. 5 is a circuit diagram illustrating an electronic device in accordance with a fifth example.

FIG. 5 is a circuit diagram illustrating an electronic device 50 in accordance with a fifth example.

As depicted in FIG. 5, the electronic device 50 includes a power supply 51, a first switch 52, a load 53, a second switch 54, and a constant voltage diode 55, i.e., an example of an electric element.

The fifth example is different from the first example only in that the constant voltage diode 55, not the resistor 15 in the first example depicted in FIG. 1, is disposed within a control electric circuit C5. Accordingly, detailed descriptions are omitted herein.

The constant voltage diode 55 is disposed within the DC control electric circuit C5 as an electric element that does not generate heat at the voltage of the power supply 51 and has a Zener voltage that is higher than the voltage of the power supply 51.

Figure 6:
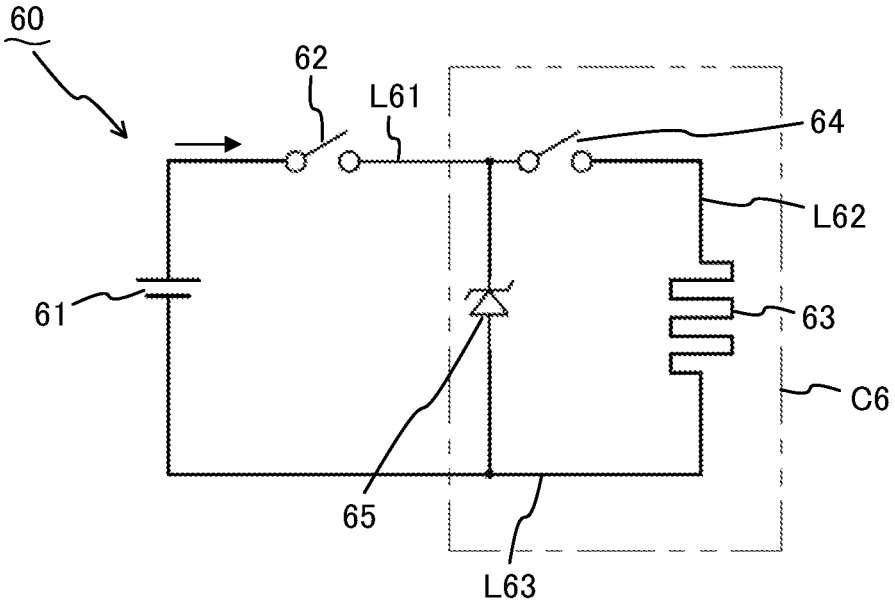
FIG. 6 is a circuit diagram illustrating an electronic device in accordance with a sixth example.

FIG. 6 is a circuit diagram illustrating an electronic device 60 in accordance with a sixth example.

As depicted in FIG. 6, the electronic device 60 includes a power supply 61, a first switch 62, a load 63, a second switch 64, and a constant voltage diode 65, i.e., an example of an electric element.

The sixth example is different from the second example only in that the constant voltage diode 65, not the resistor 25 in the second example depicted in FIG. 2, is disposed within a control electric circuit C6. Accordingly, detailed descriptions are omitted herein.

The constant voltage diode 65 is disposed within the DC control electric circuit C6 as an electric element that does not generate heat at the voltage of the power supply 61 and has a Zener voltage that is higher than the voltage of the power supply 61.

Figure 7:
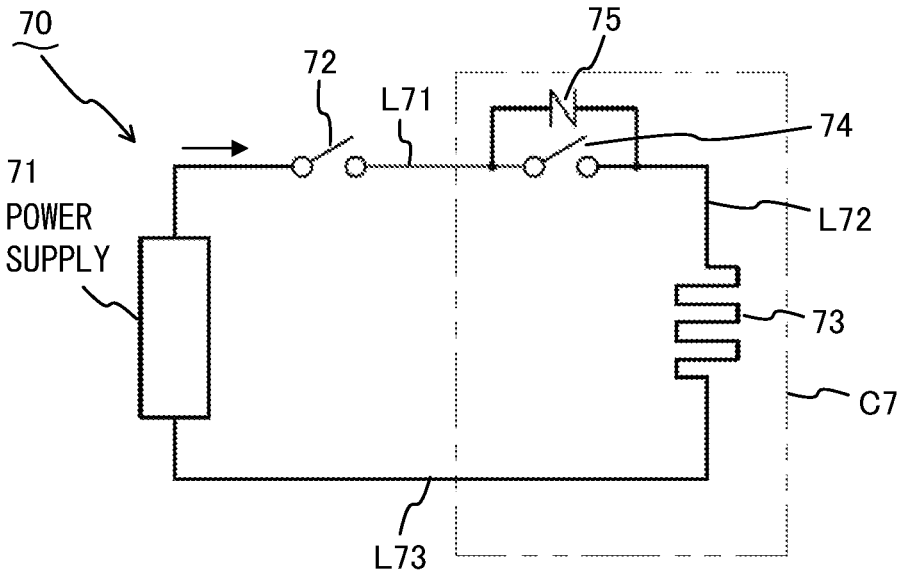
FIG. 7 is a circuit diagram illustrating an electronic device in accordance with a seventh example.

FIG. 7 is a circuit diagram illustrating an electronic device 70 in accordance with a seventh example.

As depicted in FIG. 7, the electronic device 70 includes a power supply 71, a first switch 72, a load 73, a second switch 74, and an arrester 75, i.e., an example of an electric element.

The seventh example is different from the first example only in that the arrester 75, not the resistor 15 in the first example depicted in FIG. 1, is disposed within a control electric circuit C7. Accordingly, detailed descriptions are omitted herein.

For example, the arrester 75 may be a varistor that can accommodate to the voltage of the power supply 71.

Figure 8:
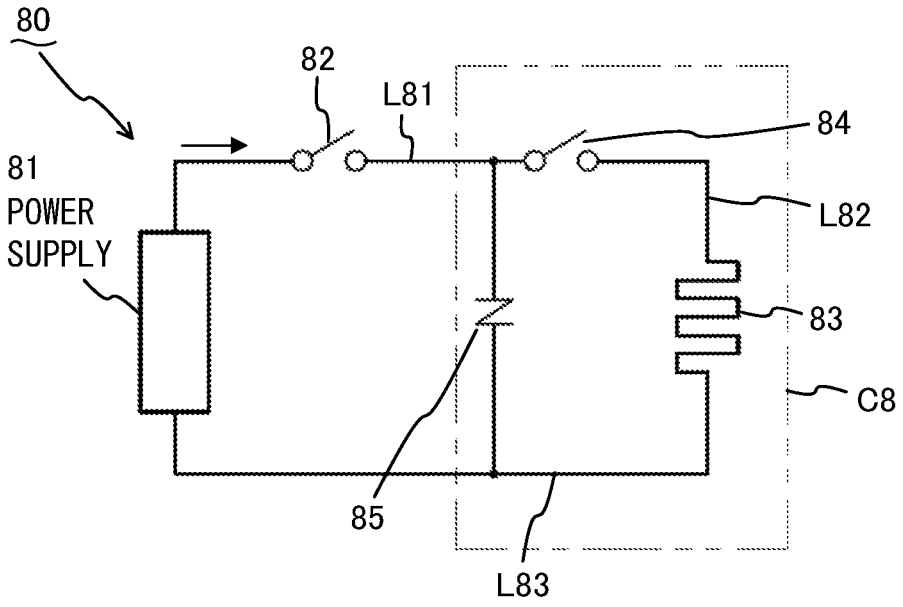
FIG. 8 is a circuit diagram illustrating an electronic device in accordance with an eighth example.

FIG. 8 is a circuit diagram illustrating an electronic device 80 in accordance with an eighth example.

As depicted in FIG. 8, the electronic device 80 includes a power supply 81, a first switch 82, a load 83, a second switch 84, and an arrester 85, i.e., an example of an electric element.

The eighth example is different from the second example only in that the arrester 85, not the resistor 25 in the second example depicted in FIG. 2, is disposed within a control electric circuit C8. Accordingly, detailed descriptions are omitted herein.

For example, the arrester 85 may be a varistor that can accommodate to the voltage of the power supply 81.

Figure 9:
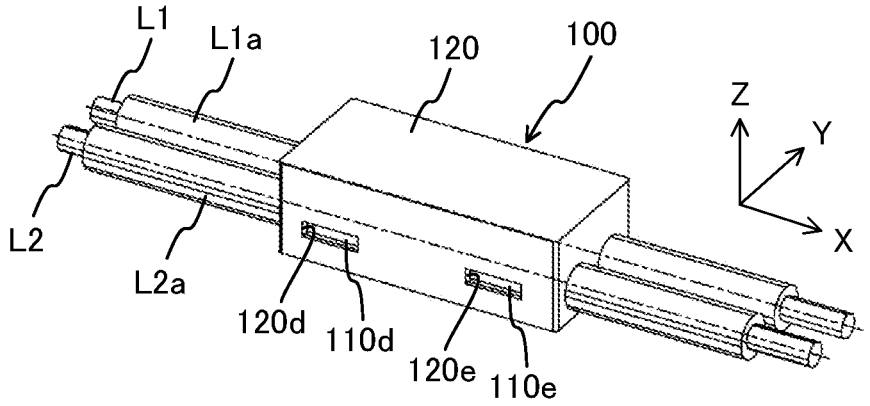
FIG. 9 is a perspective view illustrating a case in embodiments together with first and second power lines.

FIG. 9 is a perspective view illustrating a case 100 in embodiments together with a first power line L1 and a second power line L2.

Figure 10:
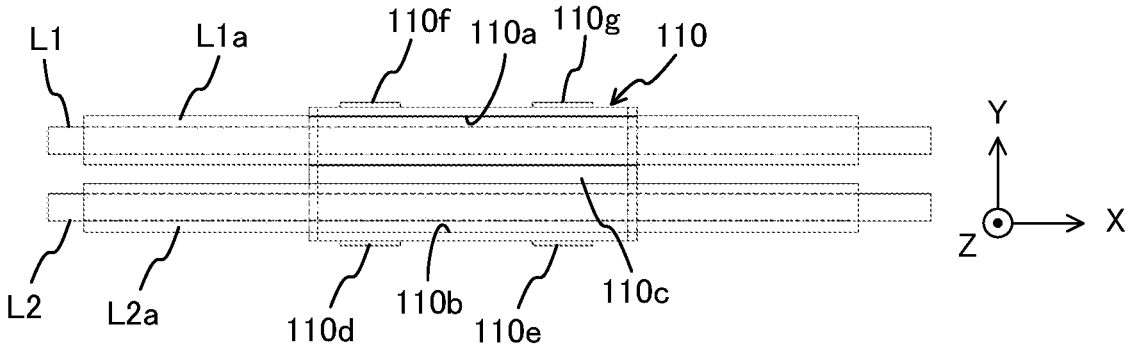
FIG. 10 is a plan view illustrating a first case member in embodiments together with first and second power lines.

FIG. 10 is a plan view illustrating a first case member 110 in embodiments together with a first power line L1 and a second power line L2.

Figure 11:
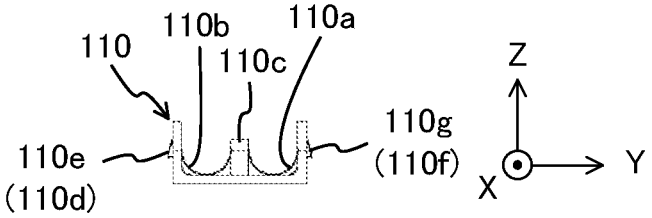
FIG. 11 is a right side view illustrating a first case member in embodiments.

FIG. 11 is a right side view illustrating a first case member 110 in embodiments.

Figure 12:
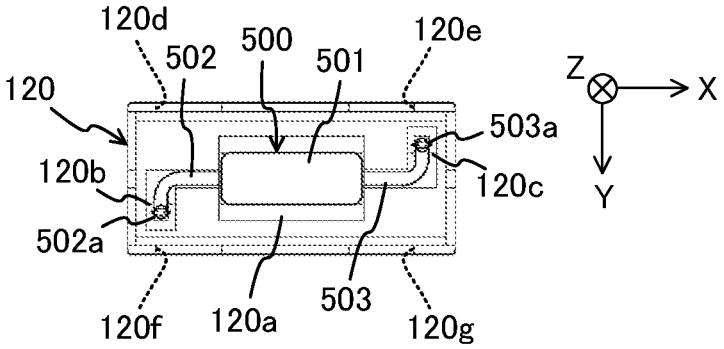
FIG. 12 is a bottom view illustrating a second case member in embodiments together with an electric element.

FIG. 12 is a bottom view illustrating a second case member 120 in embodiments together with an electric element 500.

Figure 13:
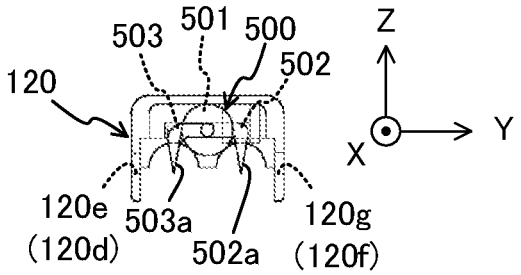
FIG. 13 is a right side view illustrating the internal structure of a second case member in embodiments together with an electric element.

FIG. 13 is a right side view illustrating the internal structure of a second case member 120 in embodiments together with an electric element 500.

Figure 14:
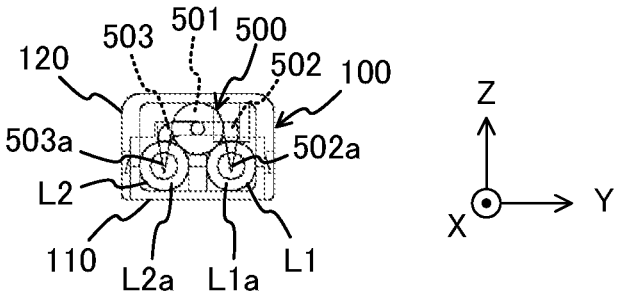
FIG. 14 is a right side view illustrating the internal structure of a case in embodiments together with a first power line, a second power line, and an electric element.

FIG. 14 is a right side view illustrating the internal structure of a case 100 in embodiments together with a first power line L1, a second power line L2, and an electric element 500.

Figure 15:
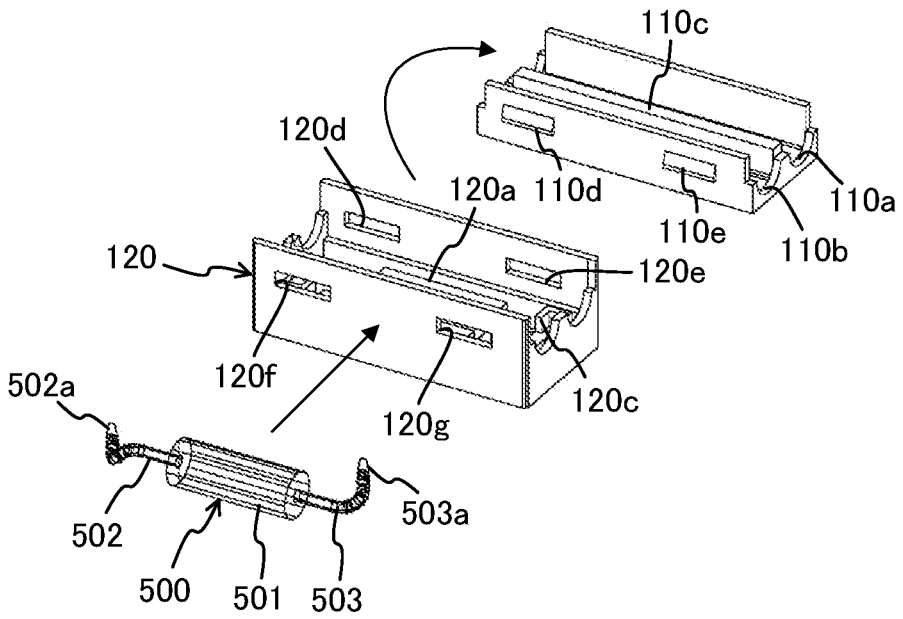
FIG. 15 is an exploded perspective view illustrating a case and an electric element in embodiments.

FIG. 15 is an exploded perspective view illustrating a case 100 and an electric element 500 in embodiments.

Figure 16:
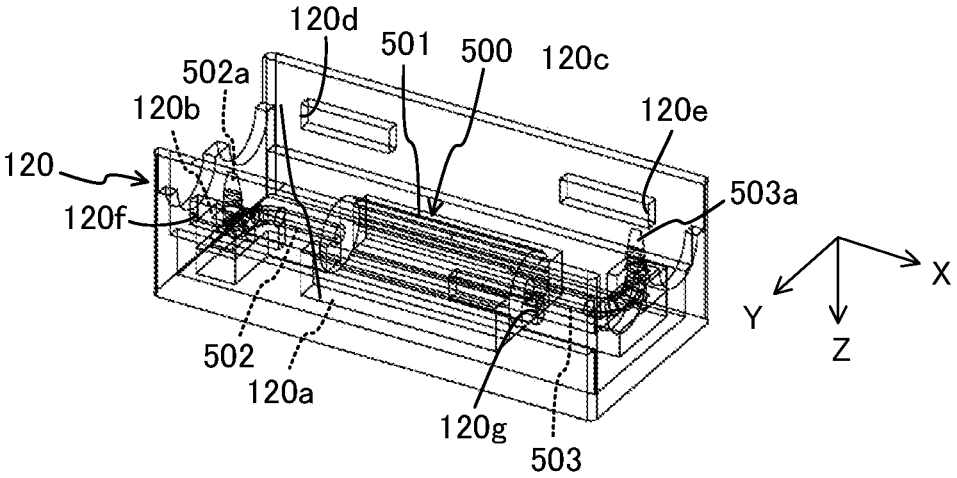
FIG. 16 is a perspective view illustrating the internal structure of a second case member in embodiments together with an electric element.

FIG. 16 is a perspective view illustrating the internal structure of a second case member 120 in embodiments together with an electric element 500.

Figure 17:
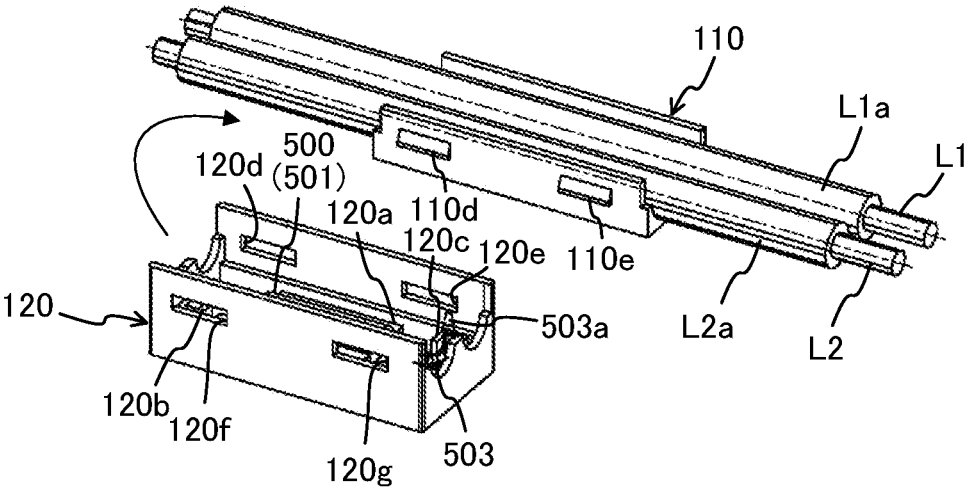
FIG. 17 is an exploded perspective view illustrating a case and an electric element in embodiments together with first and second power lines.

FIG. 17 is an exploded perspective view illustrating a case 100 and an electric element 500 in embodiments together with a first power line L1 and a second power line L2.

The X direction, Y direction, and Z direction indicated in FIGS. 9-14 and 16 are presented as examples for descriptive purposes. The X, Y, and Z directions are orthogonal to each other. The X direction is the direction of the axes of the first power line L1 (first power line L11, L21, L31, L41, L51, L61, L71, or L81) and the second power line L2 (second power line L12, L22, L32, L42, L52, L62, L72, or L82) indicated by alternate long and short dash lines in FIGS. 9 and 17. The Y direction is the direction in which the first power line L1 and the second power line L2 are arranged. The Z direction is the direction in which the first case member 110 and the second case member 120 of the case 100 are fitted with each other. Although descriptions are given of an example in which the second power line L2 is used, the third power line (third power line L13, L23, L33, L43, L53, L63, L73, or L83) may be disposed in place of the second power line L2.

The case 100 includes the first case member 110 and the second case member 120 fitted with each other. For example, the case 100 may be formed from an insulating synthetic resin. The first case member 110 and the second case member 120 each assume an essentially rectangular-solid shape having edges parallel to the X, Y, and Z directions. The first case member 110 has an opening in a forward portion thereof in the Z direction. The second case member 120 has an opening in a rear portion thereof in the Z direction.

As indicated in FIGS. 9, 10, and 17, the first power line L1 is connected to one end portion of the electric contact of the second switch 14, 24, 34, 44, 54, 64, 74, or 84 that is positioned on the side on which the first switch 12, 22, 32, 42, 52, 62, 72, or 82 is provided. At least a region on the first power line L1 over which the case 100 is disposed has a circumference on which an insulating sheath L1*a* is provided.

The second power line L2 is connected to another end portion of the electric contact of the second switch 14, 24, 34, 44, 54, 64, 74, or 84 (i.e., the end portion on the opposite side from the first switch 12, 22, 32, 42, 52, 62, 72, or 82). At least a region on the second power line L2 over which the case 100 is disposed has a circumference on which an insulating sheath L2*a* is provided.

For example, the electric element 500 depicted in FIGS. 12-17 may be any of the resistors 15, 25, 35, and 45, the constant voltage diodes 55 and 65, and the arrestors 75 and 85. The electric element 500 includes an electric element body 501, a first terminal 502 protruding from the electric element body 501 and connected to the first power line L1, and a second terminal 503 protruding from the electric element body 501 and connected to the second power line L2. The electric element 500 is accommodated within the case 100.

For example, the first terminal 502 may protrude rearward from the electric element body 501 in the X direction, then be vertically bent forward in the Y direction, and finally be vertically bent rearward in the Z direction. The first terminal 502 includes a first tapered section 502*a* at the leading end portion thereof on the opposite side from the electric element body 501, i.e., at the portion thereof extending rearward in the Z direction.

For example, the second terminal 503 may protrude forward from the electric element body 501 in the X direction, then be vertically bent rearward in the Y direction, and finally be vertically bent rearward in the Z direction. The second terminal 503 includes a second tapered section 503*a* at the leading end portion thereof on the opposite side from the electric element body 501, i.e., at the portion thereof extending rearward in the Z direction.

As indicated in FIGS. 11, 14, and 15, the first case member 110 includes a first power-line holding section 110*a* for holding the sheath L1*a* for the first power line L1 and a second power-line holding section 110*b* for holding the sheath L2*a* for the second power line L2. The first case member 110 also includes, as a partition between the first power line L1 and the second power line L2, a partition wall 110*c* shaped like, for example, a flat plate and protruding forward in the Z direction. The first power-line holding section 110*a* is, for example, a recessed section having a semicircular cross section so as to cover half of the circumference of the first power line L1. The second power-line holding section 110*b* is, for example, a recessed section having a semicircular cross section so as to cover half of the circumference of the second power line L2. These recessed sections may be provided only in both end faces of the first case member 110 in the X direction.

As depicted in FIGS. 10, 11, and 15, locking lugs 110*d* and 110*e* protruding rearward in the Y direction are provided on the rear surface of the first case member 110 in the Y direction. Locking lugs 110*f* and 110*g* protruding forward in the Y direction are provided on the front surface of the first case member 110 in the Y direction.

As indicated in FIGS. 12, 15, and 16, the second case member 120 includes an electric-element-body holding section 120*a* for holding the electric element body 501, a first terminal holding section 120*b* for holding the first terminal 502, and a second terminal holding section 120*c* for holding the second terminal 503. For example, a pair of electric-element-body holding sections 120*a*, which may be shaped like, for example, flat plates protruding rearward in the Z direction, may be disposed to sandwich the electric element body 501. For example, the first terminal holding section 120*b* may protrude rearward in the Z direction in such a manner as to clamp at least a portion of the first terminal 502. For example, the second terminal holding section 120*c* may protrude rearward in the Z direction in such a manner as to clamp at least a portion of the second terminal 503. As depicted in FIG. 16, as with the first case member 10, the second case member 120 includes recessed sections provided in both end faces thereof in the X direction which have semicircular cross sections so as to cover halves of the circumferences of the first power line L1 and the second power line L2.

As depicted in FIGS. 9 and 15-17, locking holes 120*d* and 120*e* into which the locking lugs 110*d* and 110*e* are inserted are provided in the rear surface of the second case member 120 in the Y direction. Locking holes 120*f* and 120*g* into which the locking lugs 110*f* and 110*g* are inserted are provided in the front surface of the second case member 120 in the Y direction. The first case member 110 and the second case member 120 are locked by the locking lugs 110*d*, 110*e*, 110*f*, and 110*g* being inserted into the locking holes 120*d*, 120*e*, 120*f*, and 120*g*.

As depicted in FIGS. 15 and 17, when fitting the first case member 110 and the second case member 120 with each other, first, the electric element 500 is held on the second case member 120, and the first power line L1 and the second power line L2 are held on the first case member 110. Then, as a result of the first case member 110 and the second case member 120 being fitted with each other, the first tapered section 502*a* of the first terminal 502 pierces through the sheath L1*a* for the first power line L1, and the second tapered section 503*a* of the second terminal 503 pierces through the sheath L2*a* for the second power line L2. In this way, the electric element 500 is connected to the first power line L1 at the first terminal 502 and connected to the second power line L2 at the second terminal 503.

The case 100 that includes the first case member 110 and the second case member 120 fitted with each other is used, as described above, to connect the first tapered section 502*a* of the first terminal 502 of the electric element 500 to the first power line L1 and connect the second tapered section 503*a* of the second terminal 503 to the second power line L2 (or the third power line), so that the electric element 500 can be easily connected between the first power line L1 and the second power line L2 in parallel to the electric contact of the second switch 14, 24, 34, 44, 54, 64, 74, or 84 (or can be easily connected between the first power line L1 and the third power line).

In addition, the first case member 100 includes the first power-line holding section 110*a* and the second power-line holding section 110*b*, while the second case member 120 includes the electric-element-body holding section 120*a*, the first terminal holding section 120*b*, and the second terminal holding section 120*c*, so that the electric element 500 can be easily and reliably connected in parallel to the electric contact of the second switch 14, 24, 34, 44, 54, 64, 74, or 84.

Embodiments of the present invention have been described, but the invention falls within the scope of the invention set forth in the claims and within the equivalent thereof. The following indicates, as appendixes, the invention recited in the claims of the present application as originally filed.

Appendix 1. An electronic device comprising:

a power supply;

a first switch that is connected at least to one pole of the power supply and interrupts power supplied from the power supply to a load;

a second switch that is positioned on a load side with reference to the first switch and interrupts power supplied from the power supply to the load;

a first power line that is connected to one end portion of an electric contact of the second switch, the one end portion being located on a first-switch side;

a second power line that is connected to another end portion of the electric contact of the second switch;

a third power line that is connected to another pole of the power supply; and an electric element that is connected between the first and second power lines in parallel to the electric contact or connected between the first and third power lines, such that the electric contact of the second switch is not charged when the first and second switches interrupt power.

Appendix 2. The electronic device of appendix 1, wherein the electric element is a resistor, and power consumption of the resistor is less than 0.1 W.

Appendix 3. The electronic device of appendix 1, wherein a direct current flows through the electric element, and the electric element is a constant voltage diode.

Appendix 4. The electronic device of appendix 1, wherein the electric element is an arrester.

Appendix 5. The electronic device of any of appendixes 1-4, comprising:

a case that includes first and second case members fitted with each other, wherein the electric element includes an electric element body, a first terminal protruding from the electric element body and connected to the first power line, and a second terminal protruding from the electric element body and connected to the second or third power line, the electric element is accommodated within the case, the first terminal includes a first tapered section at a leading end portion thereof on an opposite side from the electric element body, the second terminal includes a second tapered section at a leading end portion thereof on an opposite side from the electric element body, and the electric element is arranged such that owing to the first and second case members being fitted with each other, the first tapered section pierces through a sheath for the first power line and the second tapered section pierces through a sheath for the second or third power line.

Appendix 6. The electronic device of appendix 5, wherein the first case member includes a first power-line holding section for holding the sheath for the first power line and a second power-line holding section for holding the sheath for the second or third power line, and the second case member includes an electric-element-body holding section for holding the electric element body, a first terminal holding section for holding the first terminal, and a second terminal holding section for holding the second terminal.

EXPLANATION OF THE CODES

10, 20, 30, 40, 50, 60, 70, 80: Electronic device
11, 21, 31, 41, 51, 61, 71, 81: Power supply
12, 22, 32, 42, 52, 62, 72, 82: First switch
13, 23, 33, 43, 53, 63, 73, 83: Load
14, 24, 34, 44, 54, 64, 74, 84: Second switch
15, 25, 35, 45: Resistor
36, 46: Third switch
55, 65: Constant voltage diode
75, 85: Arrester
100: Case
110: First case member
110*a*: First power-line holding section
110*b*: Second power-line holding section
110*c*: Partition wall
110*d*, 110*e*, 110*f*, 110*g*: Locking lug
120: Second case member
120*a*: Electric-element-body holding section
120*b*: First terminal holding section
120*c*: Second terminal holding section
120*d*, 120*e*, 120*f*, 120*g*: Locking hole
500: Electric element
501: Electric element body
502: First terminal
502*a*: First tapered section
503: Second terminal
503*a*: Second tapered section
C1-C8: Control electric circuit
L1, L11, L21, L31, L41, L51, L61, L71, L81: First power line
L1*a*: Sheath
L2, L12, L22, L32, L42, L52, L62, L72, L82: Second power line
L2*a*: Sheath
L13, L23, L33, L43, L53, L63, L73, L83: Third power line

The invention claimed is:

1. An electronic device comprising:

a power supply;

a first switch that is connected at least to one pole of the power supply and interrupts power supplied from the power supply to a load;

a second switch that is positioned on a load side with reference to the first switch and interrupts power supplied from the power supply to the load;

a first power line that is connected to one end portion of an electric contact of the second switch, the one end portion being located on a first-switch side;

a second power line that is connected to another end portion of the electric contact of the second switch;

a third power line that is connected to another pole of the power supply;

an electric element that is connected between the first and second power lines in parallel to the electric contact or connected between the first and third power lines, such that the electric contact of the second switch is not charged when the first and second switches interrupt power; and a case that includes first and second case members fitted with each other, wherein:

the electric element includes an electric element body, a first terminal protruding from the electric element body and connected to the first power line, and a second terminal protruding from the electric element body and connected to the second or third power line, the electric element is accommodated within the case, the first terminal includes a first tapered section at a leading end portion thereof on an opposite side from the electric element body, the second terminal includes a second tapered section at a leading end portion thereof on an opposite side from the electric element body, and the electric element is arranged such that owing to the first and second case members being fitted with each other, the first tapered section pierces through a sheath for the first power line and the second tapered section pierces through a sheath for the second or third power line.

2. The electronic device of claim 1, wherein:

the electric element is a resistor, and power consumption of the resistor is less than 0.1 W.

3. The electronic device of claim 1, wherein:

a direct current flows through the electric element, and the electric element is a constant voltage diode.

4. The electronic device of claim 1, wherein the electric element is an arrester.

5. The electronic device of claim 1, wherein:

the first case member includes a first power-line holding section for holding the sheath for the first power line and a second power-line holding section for holding the sheath for the second or third power line, and the second case member includes an electric-element-body holding section for holding the electric element body, a first terminal holding section for holding the first terminal, and a second terminal holding section for holding the second terminal.

* * * * *